US008739972B1

(12) United States Patent
Schall

(10) Patent No.: US 8,739,972 B1
(45) Date of Patent: Jun. 3, 2014

(54) INSULATED BEVERAGE HOLDER WITH INTEGRATED ALCOHOL BEVERAGE COUNTER

(71) Applicant: Anthony J. Schall, Lake Worth, TX (US)

(72) Inventor: Anthony J. Schall, Lake Worth, TX (US)

( * ) Notice: Subject to any disclaimer, the term of this patent is extended or adjusted under 35 U.S.C. 154(b) by 9 days.

(21) Appl. No.: 13/669,547

(22) Filed: Nov. 6, 2012

(51) Int. Cl.
*B65D 85/00* (2006.01)
*B65D 25/00* (2006.01)
*G08B 1/08* (2006.01)

(52) U.S. Cl.
USPC ..... 206/459.1; 220/737; 340/539.1

(58) Field of Classification Search
USPC ..... 206/459.1, 459.5; 220/592.16, 592.17, 220/592.23–592.25, 737–740; 40/324; 116/315; 340/539.1; 368/10, 89, 107, 368/108
See application file for complete search history.

(56) References Cited

U.S. PATENT DOCUMENTS

| | | | | |
|---|---|---|---|---|
| 5,339,548 | A | 8/1994 | Russell | |
| D360,806 | S | 8/1995 | Morris et al. | |
| 5,492,246 | A * | 2/1996 | Bailey | 220/737 |
| 6,483,440 | B1 | 11/2002 | Welch | |
| 6,914,536 | B2 | 7/2005 | Gratkowski | |
| D587,068 | S | 2/2009 | Rocco | |
| 8,157,437 | B2 | 4/2012 | Richmond | |
| 2003/0210141 | A1 * | 11/2003 | Iacovino | 340/539.1 |
| 2008/0093370 | A1 | 4/2008 | Darsey | |

* cited by examiner

*Primary Examiner* — Bryon Gehman
(74) *Attorney, Agent, or Firm* — Kyle A. Fletcher, Esq.

(57) ABSTRACT

The insulated beverage holder with integrated alcohol beverage counter includes an insulated beverage holder that is outfitted with a beverage counting mechanism. The beverage counting mechanism is able to count the number of times a beverage is consumed by counting the number of times a beverage container is replaced thereby informing the end user of the number of alcohol drinks consumed. A perimeter surface of the insulated beverage holder is adorned with a diagram that correlates the number of drinks to the applicable weight of the end user in order to calculate the approximate blood alcohol percentage. The beverage counting mechanism includes a switch in wired communication with a processing member. The processing member counts the number of times a signal is transmitted from the switch, and is further wired to a powering member, reset button, and a display.

12 Claims, 5 Drawing Sheets

| Drinks | Weight in Pounds: 100 | 120 | 140 | 160 | 180 | 200 |
|---|---|---|---|---|---|---|
| 1 | .04 | .03 | .03 | .02 | .02 | .02 |
| 2 | .08 | .06 | .05 | .05 | .04 | .04 |
| 3 | .11 | .09 | .08 | .07 | .06 | .06 |
| 4 | .15 | .12 | .11 | .09 | .08 | .08 |
| 5 | .19 | .16 | .13 | .12 | .13 | .09 |
| 6 | .23 | .19 | .16 | .14 | .15 | .11 |
| 7 | .26 | .22 | .19 | .16 | .17 | .13 |

Approx. Blood Alcohol Percentage

INSULATED BEVERAGE HOLDER WITH INTEGRATED ALCOHOL BEVERAGE COUNTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of insulated beverage holders or Koozies, more specifically, an insulated beverage holder that includes an alcohol beverage counter mechanism therein so as to keep track of the number of alcohol drinks consumed.

Insulated beverage holders or Koozies are an invaluable way to keep drinks insulated. These are commonly used to hold a can or bottle that may or may not be an alcoholic beverage. When it is holding an alcoholic beverage, the end user nay forget the number of drinks consumed. When the end user forgets the number of drinks consumed, the end user may be unaware of his/her blood alcohol percentage. If the end user was able to easily determine the number of alcohol drinks consumed, then the end user would be further able to determine his/her blood alcohol percentage before contemplating whether or not he or she is okay to drive a car or operate heavy machinery.

The device of the present application puts away any question as to whether an end user has had to much to drink, and should therefore not get behind the wheel. The device of the present application includes an insulated beverage holder that has a beverage counting mechanism integrated therein.

B. Discussion of the Prior Art

As will be discussed immediately below, no prior art discloses an insulated beverage holder that has integrated into the design of the holder, a beverage counting mechanism; wherein the beverage counting mechanism is able to count the number of times a beverage is consumed by counting the number of times a beverage container is replaced thereby informing the end user of the number of alcohol drinks consumed; wherein a perimeter surface of the insulated beverage holder is adorned with a diagram that correlates the number of drinks to the applicable weight of the end user in order to calculate the approximate blood alcohol percentage; wherein the beverage counting mechanism includes a switch in wired communication with a processing member; wherein the processing member counts the number of times a signal is transmitted from the switch; wherein the processing member is further wired to a powering member, reset button, and a display; wherein the processing member displays a number on the display as to the number of times the switch has detected the removal of and replacement with a new beverage container; wherein the beverage counting mechanism is minimally obtrusive, and does not inhibit use of the insulated beverage container.

The Darsey Patent Application Publication (U.S. Pub. No. 2003/0093370) discloses an insulated beverage container housing. However, the housing is unable to count the number of times an empty beverage container is replaced with a new and full beverage container.

The Richmond Patent (U.S. Pat. No. 8,157,437) discloses an insulated beverage container with counting device. However, the counting device includes the total number of times a beverage has tripped the sensor as well as the number of times since the counting device has been reset. Also, the container does not include a diagram that calculates the number of alcohol drinks consumed in relation to the overall weight of the end user in order to calculate the approximate blood alcohol percentage.

The Gratkowski Patent (U.S. Pat. No. 6,914,536) discloses a timing pad for determining the amount of time used when consuming a beverage. However, the timing pad does not count the number of times an empty beverage container is replaced with a new or full beverage container with respect to an insulated beverage holder.

The Russell Patent (U.S. Pat. No. 5,339,548) discloses a receptacle display activated after the sensing of the condition of the liquid. However, the receptacle is unable to count the number of times a beverage container is replaced with respect to an insulated beverage holder.

The Welch Patent (U.S. Pat. No. 6,483,440) discloses a combined beverage holder and remote control. However, the beverage holder is unable to count the number of times a beverage container is replaced.

The Morris at al. Patent (U.S. Pat. No. Des. 360,806) illustrates an ornamental design for a beverage cooling sleeve. However, the sleeve in unable to count the number of times a beverage container is removed and replaced with a new beverage.

The Rocco Patent (U.S. Pat. No. Des. 537,068) illustrates an ornamental design for a cup with a beverage indicator, which is unable to count the number of times a beverage is consumed.

While the above-described devices fulfill their respective and particular objects and requirements, they do not describe an insulated beverage holder that has integrated into the design of the holder, a beverage counting mechanism; wherein the beverage counting mechanism is able to count the number of times a beverage is consumed by counting the number of times a beverage container is replaced thereby informing the end user of the number of alcohol drinks consumed; wherein a perimeter surface of the insulated beverage holder is adorned with a diagram that correlates the number of drinks to the applicable weighs of the end user in order to calculate the approximate blood alcohol percentage; wherein the beverage counting mechanism includes a switch in wired communication with a processing member; wherein the processing member counts the number of times a signal is transmitted from the switch; wherein the processing member is further wired to a powering member, reset button, and a display; wherein the processing member displays a number on the display as to the number of time the switch has detected the removal of and replacement with a new beverage container; wherein the beverage counting mechanism is minimally obtrusive, and does not inhibit use of the insulated beverage container. In this regard, the insulated beverage holder with integrated alcohol beverage counter departs from the conventional concepts and designs of the prior art.

SUMMARY OF THE INVENTION

The insulated beverage holder with integrated alcohol beverage counter includes an insulated beverage holder that is outfitted with a beverage counting mechanism. The beverage counting mechanism is able to count the number of times a beverage is consumed by counting the number of times a beverage container is replaced thereby informing the end user of the number of alcohol drinks consumed. A perimeter surface of the insulated beverage holder is adorned with a diagram that correlates the number of drinks to the applicable weight of the end user in order to calculate the approximate blood alcohol percentage. The beverage counting mechanism includes a switch in wired communication with a processing member. The processing member counts the number of times a signal is transmitted from the switch, and is further wired to a powering member, reset button, and a display. The processing member displays a number on the display as to the number of times the switch has detected the removal of and replacement with a new beverage container.

It is an object of the invention to provide an insulated beverage holder that is able to count the number of times a beverage container is replaced.

A further object of the invention is to provide a perimeter surface with a display therein, which depicts the number of times a beverage container has been replaced.

An even further object of the invention is to provide a diagram elsewhere on the perimeter surface, which correlates the number of drinks to the total body weight in order to determine the approximate blood alcohol percentage.

A further object of the invention is to provide an insulated beverage holder that is able to function in a traditional sense, but which includes the beverage counting mechanism.

An even further object of the invention is to provide a switch that is integrated into an inner surface of the insulated beverage holder.

These together with additional objects, features and advantages of the insulated beverage holder with integrated alcohol beverage counter will be readily apparent to those of ordinary skill in the art upon reading the following detailed description of presently preferred, but nonetheless illustrative, embodiments of the insulated beverage holder with integrated alcohol beverage counter when taken in conjunction with the accompanying drawings.

In this respect, before explaining the current embodiments of the insulated beverage holder with integrated alcohol beverage counter in detail, it is to be understood that the insulated beverage holder with integrated alcohol beverage counter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the insulated beverage holder with integrated alcohol beverage counter.

It is therefore important that the claims be regarded as including such equivalent construction insofar as they do not depart from the spirit and scope of the insulated beverage holder with integrated alcohol beverage counter. It is also to be understood that the phraseology and terminology employed herein are far purposes of description, and should not be regarded as limiting.

BRIEF DESCRIPTION OF THE DRAWINGS

The accompanying drawings, which are included to provide a further understanding of the invention and are incorporated in and constitute a part of this specification, illustrate embodiments oil the invention and together with the description serve to explain the principles of the invention.

In the drawings.

DETAILED DESCRIPTION OF THE EMBODIMENT

Figure 1:
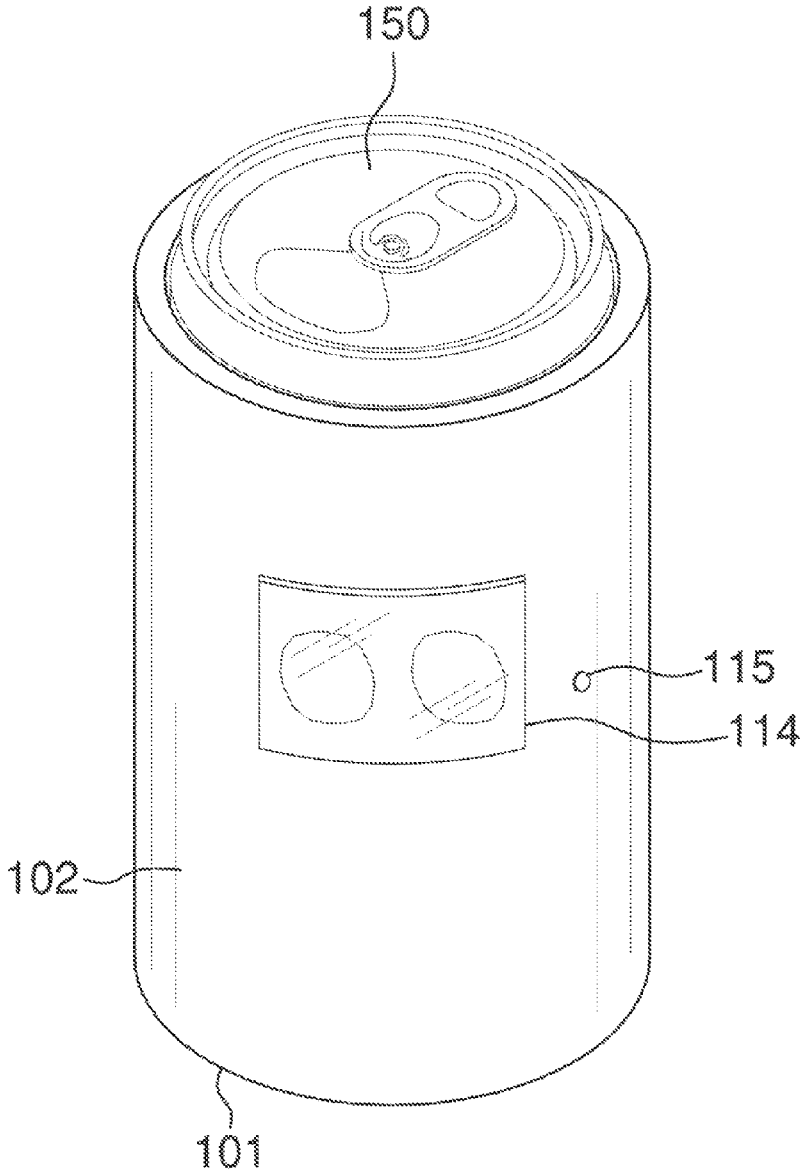
FIG. 1 illustrates a perspective view of the insulated beverage holder with integrated alcohol beverage counter.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. An insulated beverage holder with integrated alcohol beverage counter 100 (hereinafter invention) includes an insulated beverage holder 101 that is further defined with an exterior, perimeter surface 102, and an interior surface 103. The invention 100 includes a beverage counting mechanism 130 that is integrated into the construction of the insulated beverage holder 101.

The insulated beverage holder 101 is able to support a beverage container 150. It shall be noted that the term beverage container 150 may involve the use of an aluminum can, glass bottle, or plastic bottle therein. The beverage counting mechanism 110 includes a switch 111 that is located on the interior surface 103, and which detects the number of times the beverage container 150 is removed and replaced with respect to the insulated beverage holder 101.

The switch 111 is in wired communication via a wire 112 to a processing member 113. The processing member 113 is also in wired communication with a display 114, a reset button 115, and a powering member 116. The display 114 is located on the exterior, perimeter surface 102 and is highly visible as to the number that is represented thereon. The powering member 116 and the processing member 113 may be fully encompassed within the construction of the insulated beverage holder 101, which is usually a soft foam.

Figure 5:
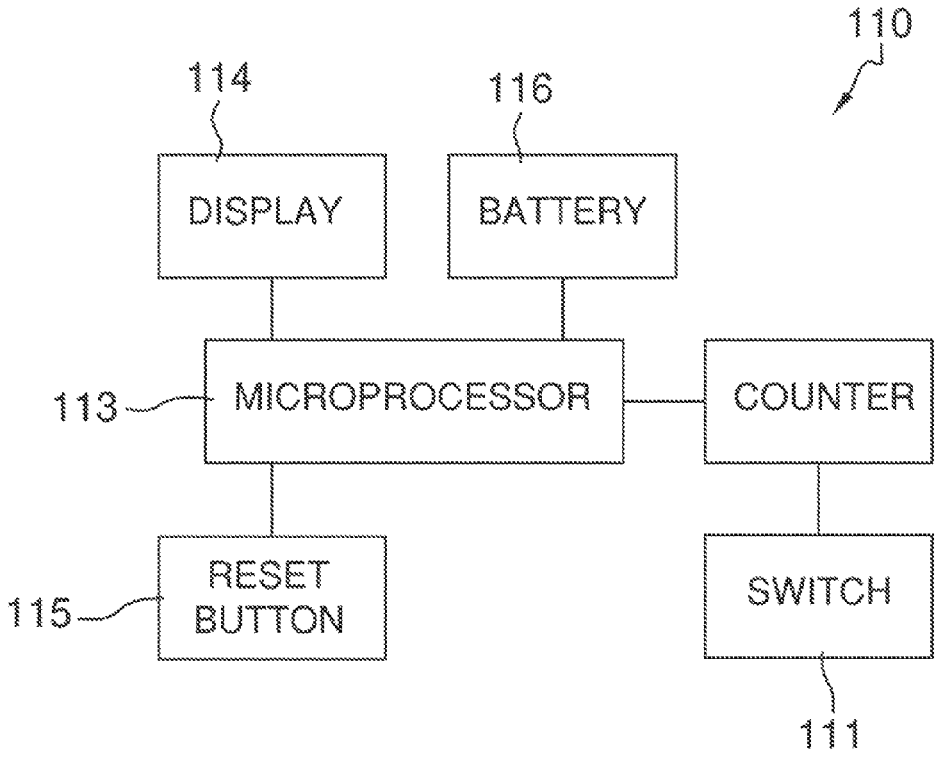
FIG. 5 illustrates a block diagram of the various components associated with the insulated beverage holder with integrated alcohol beverage counter.

It shall be noted that the term powering member 116 is being used to refer to at least one battery, which is represented as such in FIG. 5. The powering member 116 may be fully encompassed within the construction oil the insulated beverage holder 101. Alternatively, the powering member 116 may be rechargeable and/or replaceable.

The switch 111 includes a roller member 119 that does not prevent the beverage container 150 from sliding down into the insulated beverage holder 101 or from sliding upwardly during removal there from. The roller member 119 is engaged to the switch 111 via a pivot member 118. The pivot member 118 is responsible for enabling switch contacts 180 to meet thereby closing the circuit formed with respect to the processing member 113.

The processing member 113 may include the reset button 115, which extends outwardly through the exterior, perimeter surface 102. Upon depression of the reset button 115 the processing member 113 shall reset the number displayed on the display 114 to zero. It shall be noted that the beverage counting mechanism 110 does not detract from the overall function of the insulated beverage holder 101.

Figure 2:
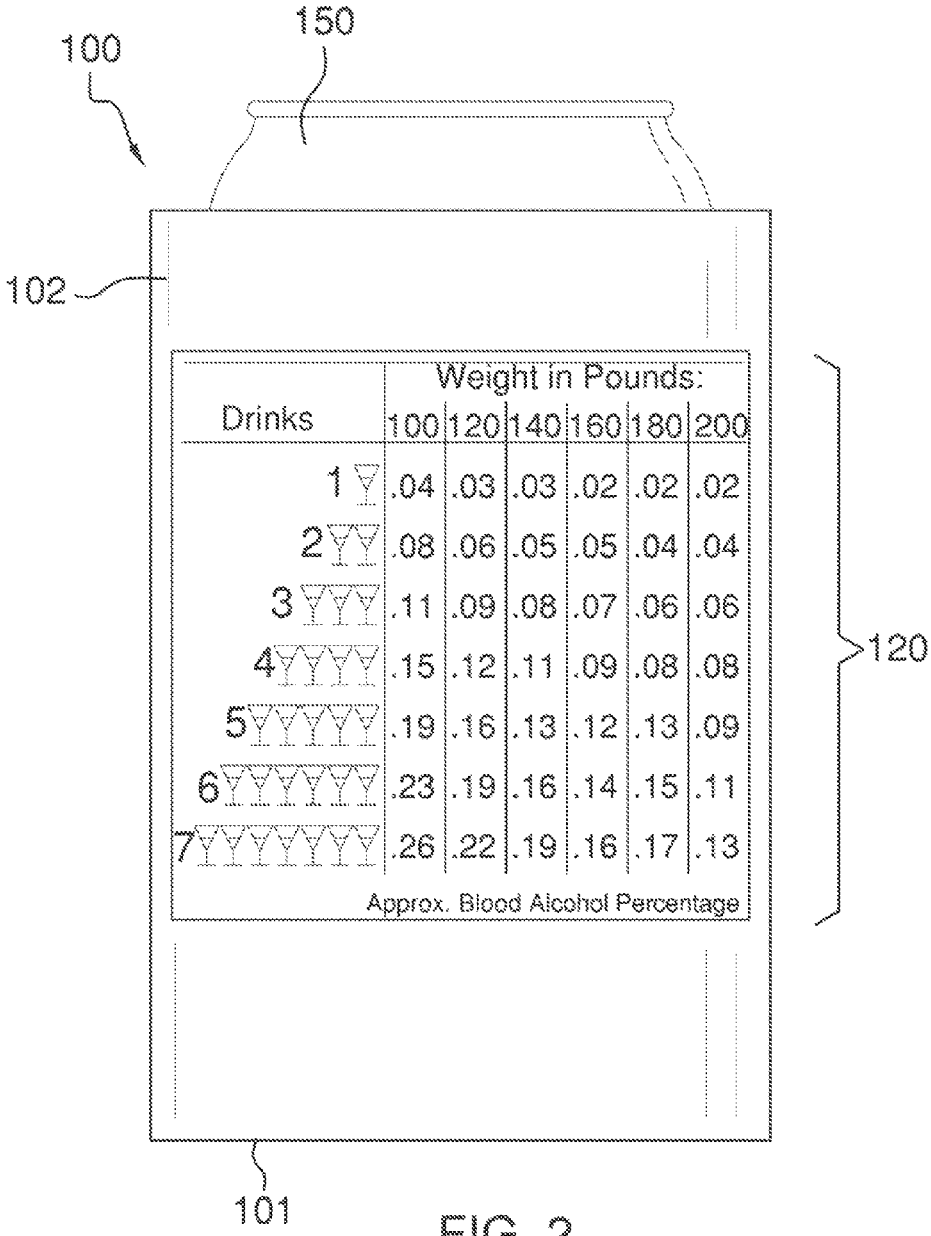
FIG. 2 illustrates a tear view of the diagram provided on the perimeter surface of the insulated beverage holder.
Figure 3:
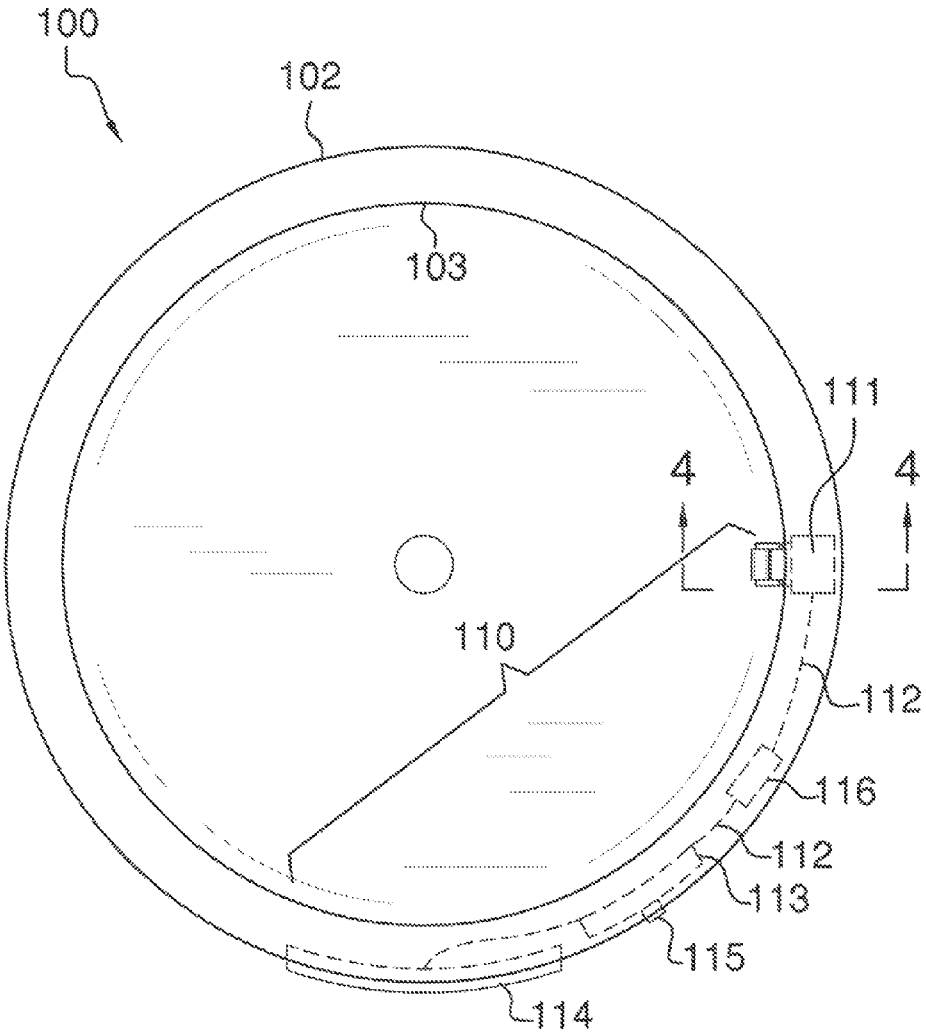
FIG. 3 illustrates a top view of the insulated beverage holder with integrated alcohol beverage counter, and depicting the applicable connections between the several components forming the beverage counting mechanism.
Figure 4A:
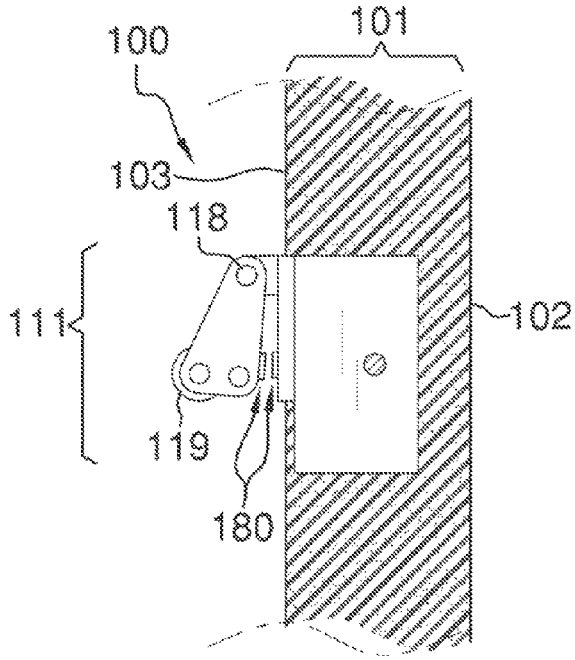
FIG. 4A illustrates a cross-sectional view along line 4-4 in FIG. 3, and depicting the switch.
Figure 4B:
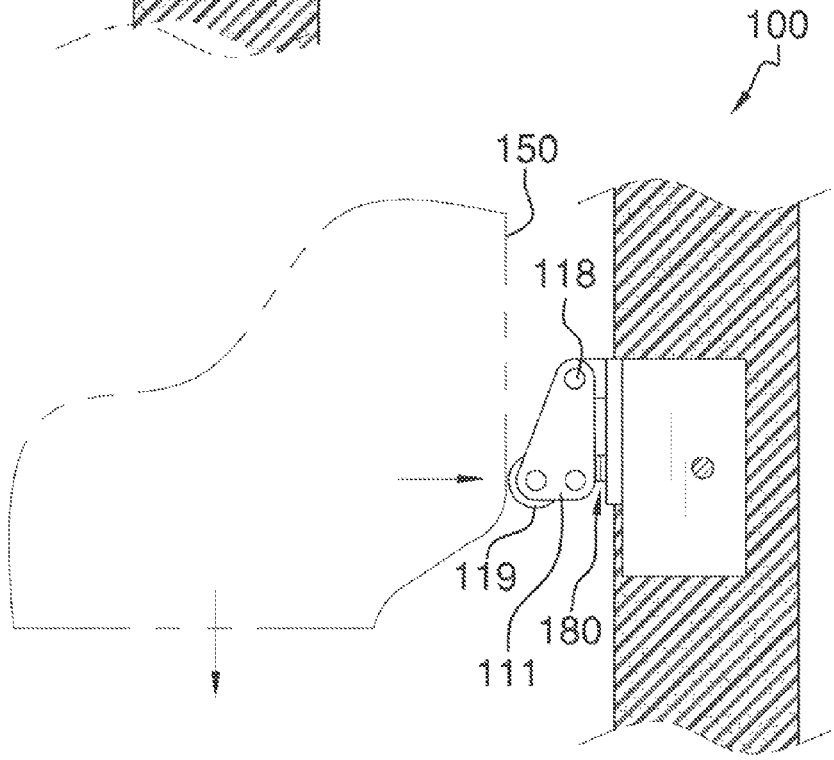
FIG. 4B illustrates a cross-sectional view along line 4-4 in FIG. 3, and depicting a beverage container engaging the switch.

Referring to FIG. 2, the invention 100 includes a diagram 120 elsewhere on the exterior, perimeter surface 102. The diagram 120 is designed to translate the number of drinks consumed in relation to the overall body weight of the end user into an approximate blood alcohol percentage. It is the use of the diagram that will enable the end user to determine if he or she has had too much to drink, which would cause he or she to get a DUI in the event that he or she decided to drive. The diagram 120 will better assist the end user in making the determination as to whether he or she is able to drive or should find an alternative means of transport (e.g., call a cab).

With respect to the above description, it is to be realized that the optimum dimensional relationship for the various components oil the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An insulated beverage holder with integrated alcohol beverage counter comprising:

said insulated beverage holder includes a beverage counting mechanism therein; said beverage counting mechanism displays the number of alcohol beverages consumed by being adapted to detect and count the number of times a beverage container is inserted and removed with respect to said insulated beverage holder;

wherein an exterior, perimeter surface of the insulated beverage holder includes a display that displays the number of times the beverage counting mechanism has detected a beverage container being replaced with respect to the insulated beverage holder;

wherein the exterior, perimeter surface of the insulated beverage holder includes a diagram that correlates the number of alcohol drinks consumed in relation to the overall body weight in order to calculate the approximate blood alcohol percentage.

2. The insulated beverage holder with integrated alcohol beverage counter as described in claim 1 wherein the insulated beverage holder is further defined with an interior surface.

3. The insulated beverage holder with integrated alcohol beverage counter as described in claim 2 wherein the beverage counting mechanism includes a switch that is located on the interior surface, and which detects the number of times the beverage container is removed and replaced with respect to the insulated beverage holder.

4. The insulated beverage holder with integrated alcohol beverage counter as described in claim 3 wherein the switch is in wired communication via a wire to a processing member, which is also in wired communication with the display, a reset button, and a powering member.

5. The insulated beverage holder with integrated alcohol beverage counter as described in claim 4 wherein the display is located elsewhere on the exterior, perimeter surface with respect to the diagram.

6. The insulated beverage holder with integrated alcohol beverage counter as described in claim 4 wherein the switch includes a roller member that does not prevent the beverage container from sliding down into the insulated beverage holder or from sliding upwardly during removal there from; wherein the roller member is engaged to the switch via a pivot member; wherein the pivot member is responsible for enabling switch contacts to meet thereby closing the circuit formed with respect to the processing member.

7. The insulated beverage holder with integrated alcohol beverage counter as described in claim 4 wherein the processing member includes the reset button, which extends outwardly through the exterior, perimeter surface; whereupon depression of the reset button the processing member shall reset the number displayed on the display to zero.

8. An insulated beverage holder with integrated alcohol beverage counter comprising:

said insulated beverage holder includes a beverage counting mechanism therein; said beverage counting mechanism displays the number of alcohol beverages consumed by being adapted to detect and count the number of times a beverage container is inserted and removed with respect to said insulated beverage holder;

wherein an exterior, perimeter surface of the insulated beverage holder includes a display that displays the number of times the beverage counting mechanism has detected a beverage container being replaced with respect to the insulated beverage holder;

wherein the exterior, perimeter surface of the insulated beverage holder includes a diagram that correlates the number of alcohol drinks consumed in relation to the overall body weight in order to calculate the approximate blood alcohol percentage;

wherein the insulated beverage holder is further defined with an interior surface;

wherein the beverage counting mechanism includes a switch that is located on the interior surface, and which detects the number of times the beverage container is removed and replaced with respect to the insulated beverage holder.

9. The insulated beverage holder with integrated alcohol beverage counter as described in claim 8 wherein the switch is in wired communication via a wire to a processing member, which is also in wired communication with the display, a reset button, and a powering member.

10. The insulated beverage holder with integrated alcohol beverage counter as described in claim 9 wherein the display is located elsewhere on the exterior, perimeter surface with respect to the diagram.

11. The insulated beverage holder with integrated alcohol beverage counter as described in claim 10 wherein the switch includes a roller member that does not prevent the beverage container from sliding down into the insulated beverage holder or from sliding upwardly during removal there from; wherein the roller member is engaged to the switch via a pivot member; wherein the pivot member is responsible for enabling switch contacts to meet thereby closing the circuit formed with respect to the processing member.

12. The insulated beverage holder with integrated alcohol beverage counter as described in claim 11 wherein the processing member includes the reset button, which extends outwardly through the exterior, perimeter surface; whereupon depression of the reset button the processing member shall reset the number displayed on the display to zero.

* * * * *